US009009989B2

(12) United States Patent
Fuerst

(10) Patent No.: US 9,009,989 B2
(45) Date of Patent: Apr. 21, 2015

(54) FOOTWEAR WITH HYDROPLANING-RESISTANT OUTSOLE AND CAMOUFLAGED TOE CAP

(75) Inventor: Rory W. Fuerst, Portland, OR (US)

(73) Assignee: Keen, Inc., Portland, OR (US)

( * ) Notice: Subject to any disclaimer, the term of this patent is extended or adjusted under 35 U.S.C. 154(b) by 238 days.

(21) Appl. No.: 13/367,172

(22) Filed: Feb. 6, 2012

(65) Prior Publication Data

US 2013/0199058 A1 Aug. 8, 2013

(51) Int. Cl.

| | |
|---|---|
| ***A43C 15/00*** | (2006.01) |
| ***A43B 13/22*** | (2006.01) |
| ***A43B 5/08*** | (2006.01) |

(52) U.S. Cl.

CPC ..... *A43B 13/223* (2013.01); *A43B 5/08* (2013.01)

(58) Field of Classification Search

CPC ..... A43B 13/141; A43B 13/16; A43B 3/02; A43B 7/32; A43B 13/145; A43B 5/00; A43B 13/233; A43B 13/04; A43B 23/086; A43B 23/082; A43B 21/06

USPC ..... 36/102, 103, 4, 25 R, 32 R, 77 R, 59 C

See application file for complete search history.

(56) References Cited

U.S. PATENT DOCUMENTS

| | | | | |
|---|---|---|---|---|
| 354,693 | A * | 12/1886 | Dick | 36/3 B |
| 2,124,986 | A | 7/1938 | Pipes | |
| D189,234 | S | 11/1960 | Crane | |
| 4,777,738 | A | 10/1988 | Giese et al. | |
| 4,890,398 | A * | 1/1990 | Thomasson | 36/114 |
| 4,897,936 | A * | 2/1990 | Fuerst | 36/30 A |
| 4,924,606 | A | 5/1990 | Montgomery et al. | |
| 5,012,597 | A * | 5/1991 | Thomasson | 36/59 C |
| D329,131 | S | 9/1992 | Ostberg | |
| 5,423,135 | A * | 6/1995 | Poole et al. | 36/25 R |
| 6,076,283 | A * | 6/2000 | Boie | 36/59 C |
| 6,412,195 | B1 * | 7/2002 | Mack et al. | 36/77 R |
| D476,470 | S | 7/2003 | Matis et al. | |
| 7,096,605 | B1 * | 8/2006 | Kozo et al. | 36/103 |
| 7,234,251 | B2 * | 6/2007 | Fuerst et al. | 36/77 R |
| D552,333 | S * | 10/2007 | McClaskie | D2/953 |
| 7,290,356 | B2 | 11/2007 | Fuerst | |
| D560,884 | S * | 2/2008 | McClaskie et al. | D2/953 |
| 7,565,754 | B1 * | 7/2009 | Acheson et al. | 36/28 |
| 7,637,035 | B1 * | 12/2009 | Gillespie | 36/102 |
| 7,762,012 | B2 | 7/2010 | Fuerst | |
| 8,146,272 | B2 * | 4/2012 | Dukovic et al. | 36/59 C |
| 8,595,957 | B2 * | 12/2013 | McDowell et al. | 36/50.1 |
| 2003/0233770 | A1 * | 12/2003 | Foscaro | 36/50.1 |

(Continued)

*Primary Examiner* — Khoa Huynh
*Assistant Examiner* — Megan Brandon
(74) *Attorney, Agent, or Firm* — Alleman Hall McCoy Russell & Tuttle LLP

(57) ABSTRACT

An article of footwear with a hydroplaning-resistant outsole and camouflaged toe cap is disclosed. In one example, an article of footwear includes an outsole with a ground contacting surface including a first and second plurality of angled channels angled relative to longitudinal and lateral axes of the footwear. Each angled channel in the first plurality of angled channels extends from the toe to an outer edge of a mid-foot region of the outsole, and each angled channel in the second plurality of angled channels extends from a back portion of the heel to a front portion of the heel. The ground contacting surface also includes a plurality of lateral waved grooves intersecting the first and second plurality of angled channels, and a plurality of lateral waved sipes intersecting the plurality of lateral waved grooves and the first and second plurality of angled channels.

18 Claims, 4 Drawing Sheets

(56) References Cited

U.S. PATENT DOCUMENTS

| | | | | |
|---|---|---|---|---|
| 2007/0011912 | A1* | 1/2007 | Clark et al. | 36/50.1 |
| 2007/0011914 | A1* | 1/2007 | Keen et al. | 36/50.1 |
| 2007/0068039 | A1* | 3/2007 | Nau | 36/25 R |
| 2008/0078102 | A1* | 4/2008 | Kilgore et al. | 36/50.1 |
| 2008/0127523 | A1* | 6/2008 | Hauglin | 36/117.2 |
| 2008/0216355 | A1* | 9/2008 | Becker et al. | 36/102 |
| 2009/0071035 | A1* | 3/2009 | La Rochelle | 36/14 |
| 2009/0083994 | A1 | 4/2009 | Luedecke et al. | |
| 2009/0265955 | A1* | 10/2009 | Fuerst | 36/11.5 |
| 2010/0011622 | A1* | 1/2010 | Abadjian | 36/114 |
| 2010/0024253 | A1* | 2/2010 | Boyle et al. | 36/114 |
| 2010/0107448 | A1* | 5/2010 | Fallow et al. | 36/103 |
| 2010/0126039 | A1* | 5/2010 | McClaskie et al. | 36/12 |
| 2010/0126045 | A1* | 5/2010 | Rusnak | 36/112 |
| 2010/0281714 | A1* | 11/2010 | Carboy et al. | 36/25 R |
| 2010/0287792 | A1* | 11/2010 | Hide | 36/114 |
| 2011/0167672 | A1* | 7/2011 | Bond et al. | 36/28 |
| 2012/0131819 | A1* | 5/2012 | Loverin | 36/35 R |
| 2012/0167419 | A1* | 7/2012 | Park et al. | 36/77 R |
| 2012/0174433 | A1* | 7/2012 | Mahoney | 36/28 |
| 2012/0180335 | A1* | 7/2012 | Mahoney | 36/28 |
| 2012/0180341 | A1* | 7/2012 | Crowley et al. | 36/103 |
| 2012/0180344 | A1* | 7/2012 | Crowley et al. | 36/32 R |
| 2012/0285044 | A1* | 11/2012 | Bacon et al. | 36/103 |
| 2013/0118036 | A1* | 5/2013 | Gibson | 36/103 |

* cited by examiner

FOOTWEAR WITH HYDROPLANING-RESISTANT OUTSOLE AND CAMOUFLAGED TOE CAP

FIELD

The present application relates to an article of footwear with a hydroplaning-resistant outsole and/or a camouflaged toe cap.

BACKGROUND AND SUMMARY

Shoes and sandals may include an upper joined to a sole assembly. The sole assembly includes an outsole with a ground contacting surface. On a flat dry surface, an outsole made of rubber or other suitable material provides traction. However, such outsoles may not provide suitable traction on wet or slippery surfaces.

Some approaches impart grooves or incisions (siping) to increase the traction of rubber soles on wet or slippery surfaces. Grooves may permit water to flow away from the supporting surface thereby increasing traction between the surface and shoe sole and incisions may provide sharp surfaces when the sole is flexed which tend to cut through water, for example.

However, the inventors herein have recognized that traction on wet or slippery surfaces may be increased by including various intersecting features on a ground contacting surface of an outsole of a shoe.

In one example approach, an article of footwear may be provided with an outsole including a ground contacting surface, the ground contacting surface including: a first and second plurality of angled channels, the first and second plurality of angled channels angled relative to longitudinal and lateral axes of the shoe, where each angled channel in the first plurality of angled channels extends from the toe to an outer edge of a mid-foot region of the outsole, and where each angled channel in the second plurality of angled channels extends from a back portion of the heel to a front portion of the heel. Further, a plurality of lateral waved grooves may be provided intersecting the first and second plurality of angled channels, along with a plurality of lateral waved sipes intersecting the plurality of lateral waved grooves and the first and second plurality of angled channels. By including various features on a ground contacting surface of an outsole in this way, traction on wet or slippery surfaces may be increased, thus reducing hydroplaning when used in wet or slippery environments such as in water sports, boating, etc. In particular, when flooded with water, water may be directed away from the underside of the shoe via the angles channels, lateral grooves, and/or any open sipes. Further, the lateral grooves may remain in contact with a supporting surface, such as the deck of a boat, while the channels direct water away from the underside of the shoe. Additionally, the sipes may give the sole greater flexibility and traction, and may allow the wearer greater dexterity, which may be advantageous when operating a boat, for example.

With regard to another aspect of the present application, the inventor herein has recognized that while a toe covering or toe cap may be included on an article of footwear in order to protect a wearer's toes, such toe caps can sometimes detract from a shoe's overall visual unity. To address this, the toe cap may be camouflaged to substantially match the color of an upper and thus blend-in with the upper. In this way, an appearance of an article of footwear may be improved while protecting the forefoot region of the shoe. In some examples, an article of footwear may thus include toe cap co-molded with the outsole, the toe cap extending upwards over a forefoot portion of the upper, the toe cap having a first coloration and the outsole having a second coloration, the second coloration different from the first coloration. For example, the first coloration of the toe cap may be substantially the same as a coloration of the upper. In this way, efficient manufacturing may be maintained while providing a desired appearance.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
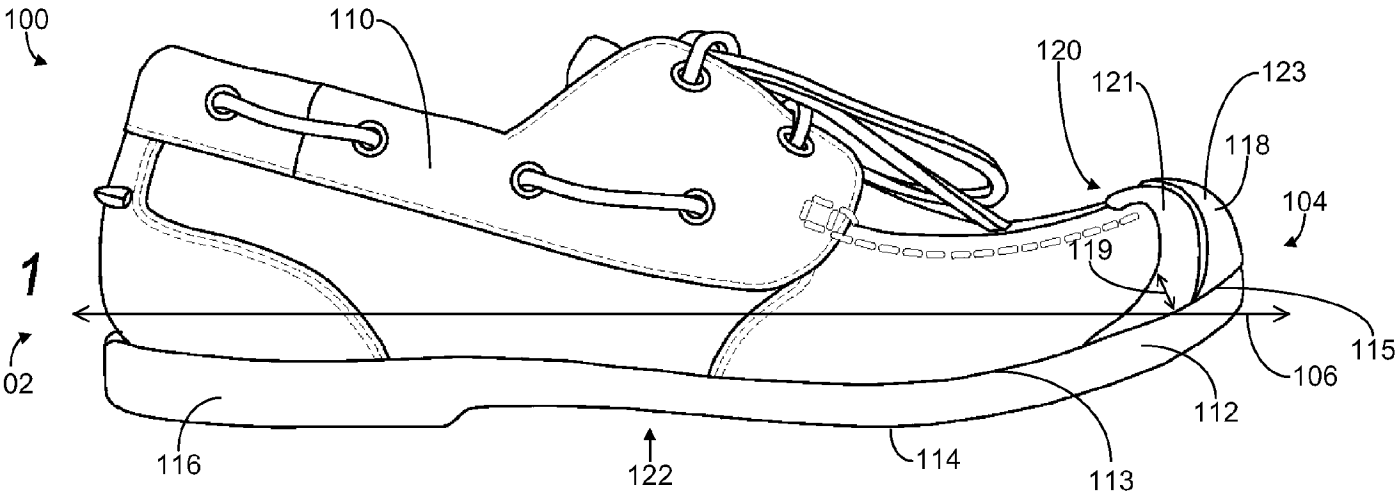
FIGS. 1-5 show various perspective views of an example embodiment of an article of footwear in accordance with the disclosure.
Figure 2:
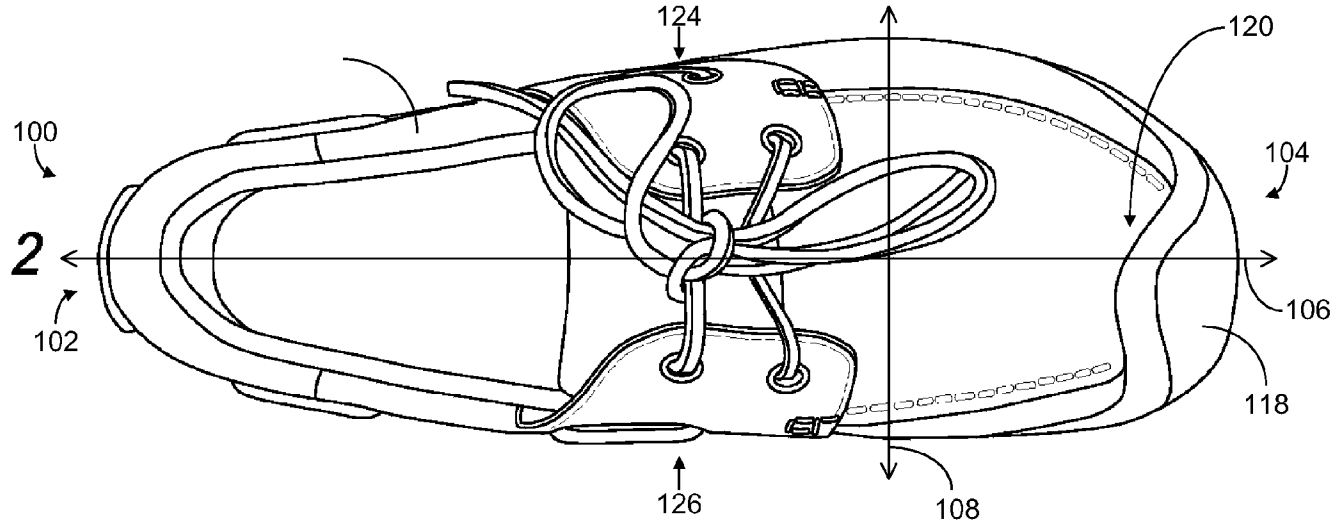
Figure 3:
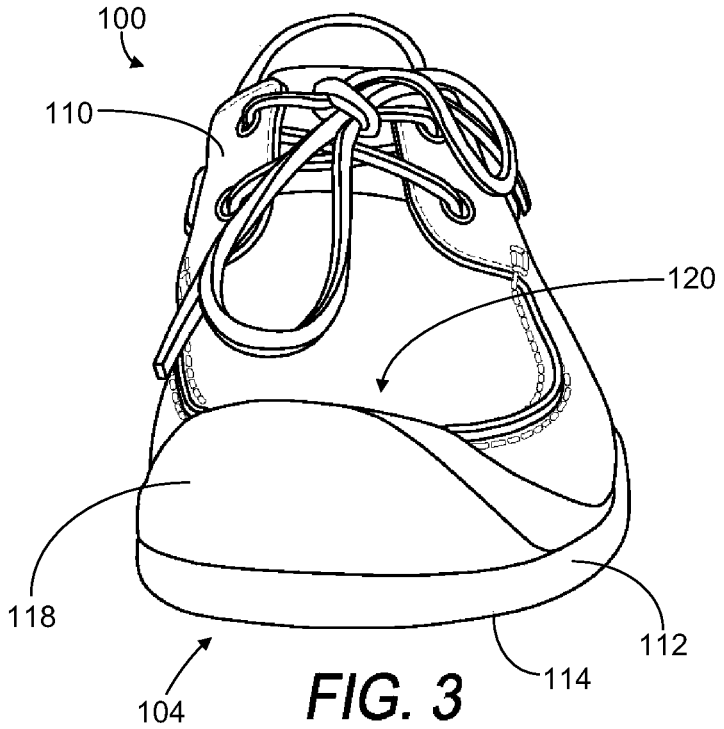

The following description relates to an article of footwear with a hydroplaning-resistant outsole and/or a camouflaged toe cap. Various intersecting features may be included on a ground contacting surface of an outsole of a shoe as shown in FIGS. 1-7, to increase traction on wet or slippery surfaces and reduce hydroplaning when used in wet or slippery environments such as in water sports, boating, etc. Further, as shown in FIGS. 1-3, an article of footwear in accordance with the disclosure may include a camouflaged toe cap colored so as to substantially match the color of an upper of the shoe. In this way, an appearance of an article of footwear may be improved while protecting the forefoot region and the toes of a wearer of the shoe. FIGS. 1-7 are drawn approximately to scale for a given sample size, however it should be understood that the shoe may be provided in a variety of sizes, from child to adult.

Figure 4:
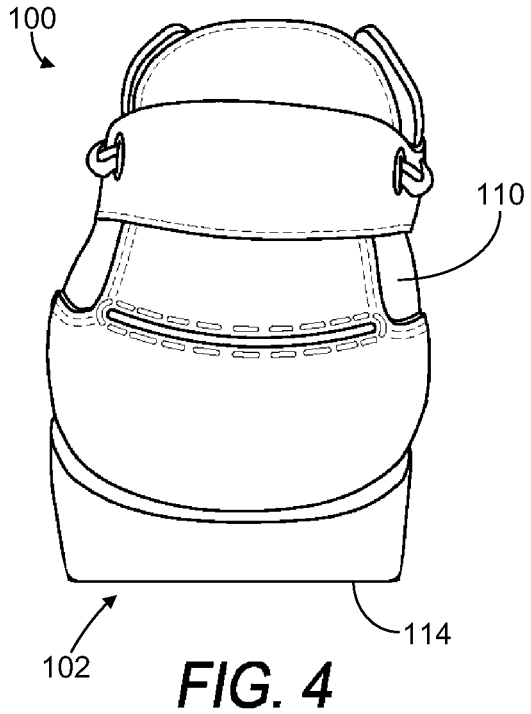
Figure 5:
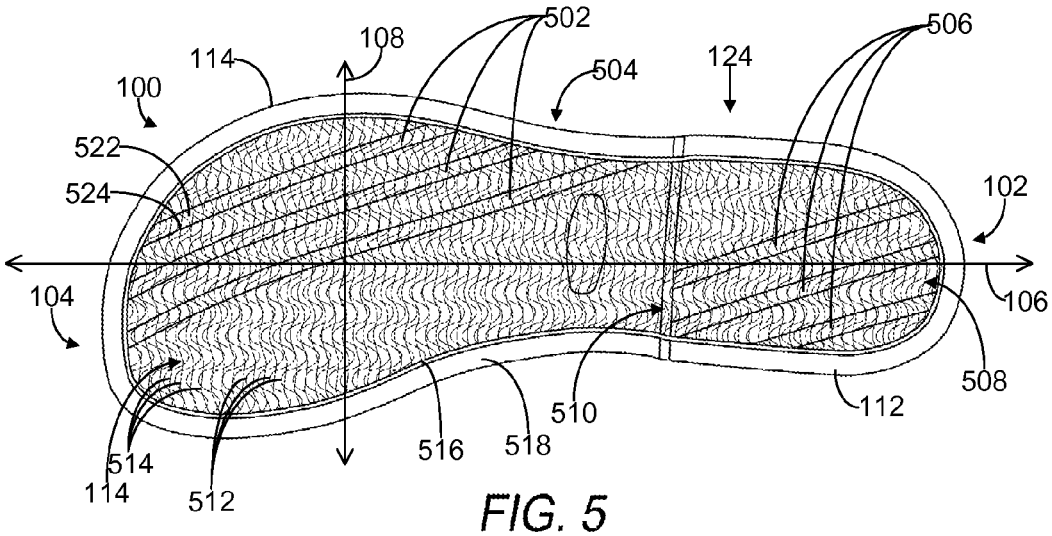
Figure 7:
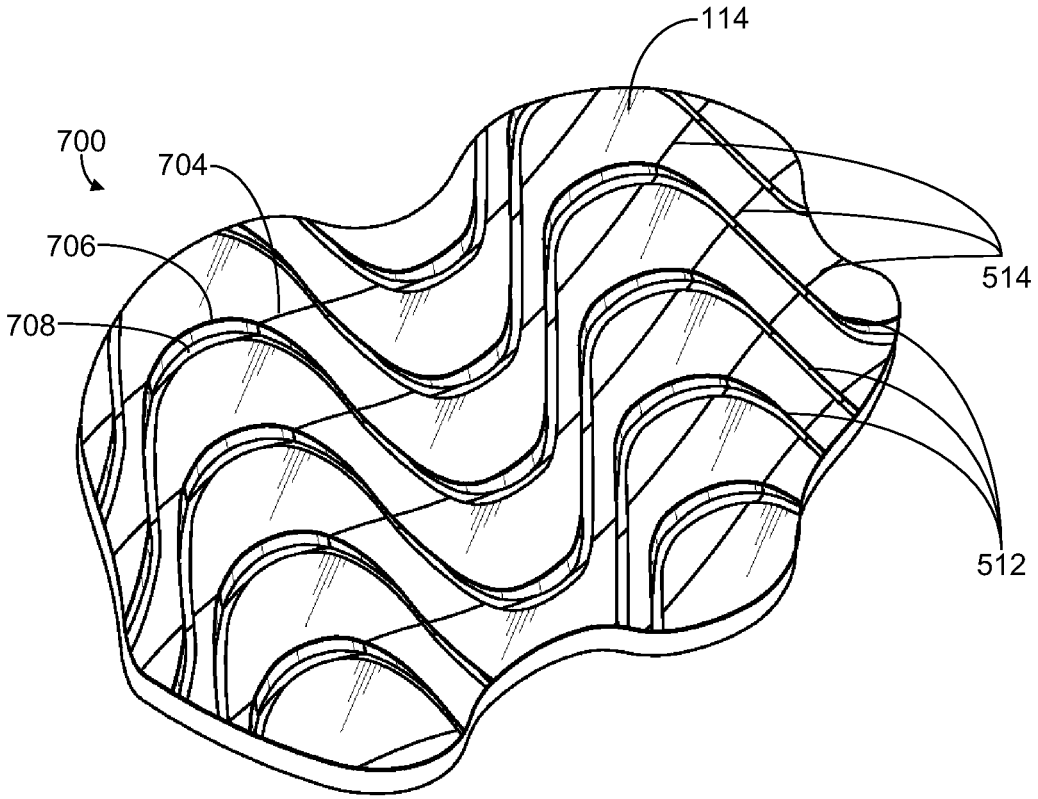
FIG. 7 shows a close up view of a ground contacting surface of an example embodiment of an article of footwear in accordance with the disclosure.

Turning now to the figures, FIGS. 1-5 and FIG. 7 show various perspective views of an example embodiment of an article of footwear 100 in accordance with the disclosure. In particular, FIG. 1 shows an outer side view of the article of footwear 100, FIG. 2 shows a top view of article of footwear 100, FIG. 3 shows a front view of article of footwear 100, FIG. 4 shows a back view of article of footwear 100, FIG. 5 shows a bottom view of article of footwear 100, and FIG. 7 shows a close up bottom view of article of footwear 100. In the following description, like numbers correspond to like elements shown in the figures. Although shown in regards to a shoe, it should be appreciated that the described article of footwear may be applied to other types of footwear, and/or to other wearable articles, including, but not limited to, boots, sandals, etc.

Article of footwear 100 includes a heel 102 positioned at a back portion of the article of footwear and a toe 104 positioned at a front portion of the article of footwear. Toe 104 is positioned on a side of the article of footwear opposing heel 102.

A longitudinal axis 106 extends between the heel 102 and the toe 104 and a lateral axis 108 perpendicular to the longitudinal axis 106 extends between an outer side 124 and an inner side 126 of the article of footwear. Further, article of footwear 100 includes a mid-foot region 122 between heel 102 and toe 104.

Article of footwear 100 comprises an upper 110 and an outsole 112 attached to the upper. As shown, article of footwear 100 may encase a foot of a wearer when worn. Article of footwear 100 may be fabricated in multiple sizes to accommodate different wearers with feet of different sizes.

The upper 110 may be composed of a variety of materials. In some examples, upper 110 may be substantially composed of leather or one or more synthetic materials, such as polyurethane or other suitable materials, or combinations thereof. In some examples, the upper may be substantially waterproof or water-resistant. Further, upper 110 may be composed of a plurality of different pieces attached to each other, e.g., via stitching, glue, etc, to form the upper. Additionally, the upper may include a variety of decorative and/or functional elements such as rivets, stitching, etc.

Outsole 112 is coupled to upper 110 at a material interface 113, e.g. via glue, welt stitching, etc. Outsole 112 may be substantially composed of a flexible, elastic material, such as rubber or the like. The outsole has an outsole heel 116 section and includes a ground contacting surface 114 which at least partially comes into contact with the ground when article of footwear 100 is worn by a wearer. For example, the outsole may extend upwards from the ground contacting surface such that portions of the outsole are not in contact with the ground.

As described in detail below with regard to FIGS. 5-7, ground contacting surface 114 may include various intersecting features to increase traction on wet or slippery surfaces and reduce hydroplaning when used in wet or slippery environments such as in water sports, boating, etc.

In some examples, article of footwear 100 may include a toe cap 118 co-molded with the outsole 112 where the toe cap 118 extends upwards over a forefoot region 120 of the upper 110 in order to protect the forefoot region and the toes of a wearer of the shoe. The toe cap may be fastened to the upper via glue, stitching, or the like. The toe cap comprises the same material as the outsole. In some examples, a height 119 of toe cap 118 may increase in a direction from heel to toe of the shoe. Further, in some examples, toe cap 118 may comprise a first section 121 on a heel side of the toe cap and a second section 123 positioned on a toe side of the toe cap. A thickness of the second section may be greater than a thickness of the first section in order to protect the toes of a wearer of the shoe.

In some examples, toe cap 118 may be camouflaged so as to substantially match the color of an upper of the shoe. Namely, the toe cap 118 may have a first coloration and the outsole 112 may have a second coloration, e.g., white, where the first coloration is different from the second coloration and the first coloration may be substantially the same as a coloration of the upper. The first coloration of the toe cap and the second coloration of the outsole form a color interface 115 between the toe cap and the outsole. This color interface may be substantially continuous with the material interface 113 between the upper and the outsole. Thus, the toe cap and the outsole may appear as two separate parts. In this way, an appearance of an article of footwear may be improved while protecting the forefoot region and the toes of a wearer of the shoe.

Figure 6:
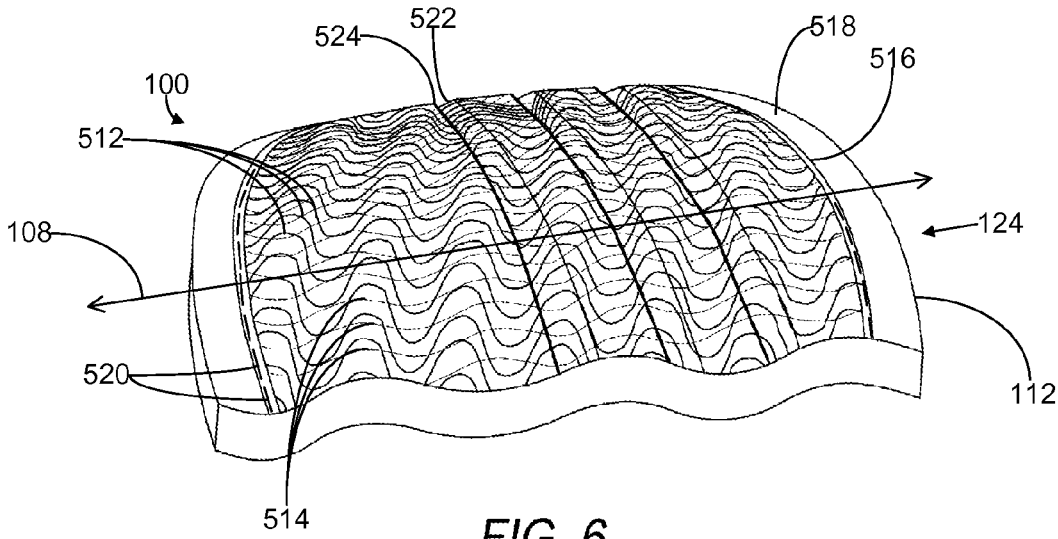
FIG. 6 shows a bottom view of an example embodiment of an article of footwear as it is bent about a lateral axis in accordance with the disclosure.

FIGS. 5 and 6 show the ground contacting surface 114 of outsole 112 of article of footwear 100 and FIG. 7 shows a close up view 700 of a portion of ground contacting surface 114. As described below, ground contacting surface 114 may include various intersecting features to increase traction on wet or slippery surfaces and reduce hydroplaning when used in wet or slippery environments.

The ground contacting surface 114 includes a first plurality of angled channels 502 angled relative to the longitudinal axis 106 and the lateral axis 108. Each angled channel in the first plurality of angled channels extends from the toe 104 to an outer edge 504 of the mid-foot region of outsole 112.

The ground contacting surface also includes a second plurality of angled channels 506 angled relative to the longitudinal axis 106 and the lateral axis 108. Each angled channel in the second plurality of angled channels extends from a back portion 508 of the heel 102 to a front portion 510 of the heel.

In some examples, each angled channel in the first plurality of angled channels may be longer than each angled channel in the second plurality of angled channels. In particular, in some examples, the length of each angled channel in the second plurality of angled channels may depend on a size of the heel of the outsole.

Further, in some examples, the first plurality of angled channels may have substantially the same angle relative to the longitudinal and lateral axes and have the same depth and shape as the second plurality of angled channels. However, in other examples the angled channels may form different angles relative to the longitudinal and lateral axes and/or may have different shapes or depths.

Each angled channel may have a first wall 522 and a second wall 524 which intersect to form the angled channel, where the first wall 522 is gradually sloped towards an outer edge or side 124 of the article of footwear and the second wall 524 is substantially perpendicular to the ground contacting surface. The second wall is on an inner side of the shoe and is abrupt. In particular, an angled channel may have a cross-section with a first substantially vertical inner side wall, where the inner side is a medial side facing a midline of a wearer's body, and a second angled outer sidewall that is angled from a trough of the channel toward an outer edge of the article of footwear. In this way, when flooded with water, such as when splashed by a wave, water will travel over the gradual slope of the first wall and impact the abrupt second wall and be directed away from the ground contacting surface.

The ground contacting surface also includes a plurality of lateral waved grooves 512 intersecting the first and second plurality of angled channels and a plurality of waved sipes 514 intersecting the plurality of lateral waved grooves and the first and second plurality of angled channels. The waved lateral grooves and lateral sipes continue over the surface of the angled-channels. Further, the lateral sipes intersect at a plurality of points with the waved lateral grooves. The sipes 514 may include cuts into the bottom ground contacting surface that are at least as deep, and possibly deeper, than the grooves 512 and the angled channels 502/506, but yet the cuts do not extend fully through the sole. Further, in one example, the cuts that form the sipes extend laterally only within the welts of the shoe. Further still, the cuts may substantially extend laterally from the welting on one side of the sole to the other, but yet end in a region spaced away from the channel 516. In this way, the cuts that form sipes do not cause the exterior sides of the sole to degrade over time, since the cuts may become snagged on various ground surface protrusions, for example. In other words, no sipe cuts are visible from the side view of FIG. 1, for example.

FIG. 7 shows a close up view 700 of ground contacting surface 114. As can be seen in FIG. 7, each groove in the plurality of waved grooves 512 forms an indentation into the ground contacting surface. In some examples, as shown in FIG. 7, a depth of the groove indentations may be less than a depth of the sipes so that the sipes form cuts which pass through and into troughs of the grooves, e.g., sipe 704 passes through groove 706 and cuts into trough 708 of groove 706.

The waved lateral grooves have a shallow depth and narrow width compared to the angled-channels. As such, they provide a large surface area, which may remain in contact with the surface, such as the deck of a boat, while the channels direct water away from the underside of the shoe.

In some examples, the lateral grooves and the lateral sipes may be sinusoidally shaped and axes of the lateral grooves may not be parallel to axes of the lateral sipes. Further, in some examples, if the lateral grooves and the lateral sipes are sinusoidally shaped, the lateral sipes may have a longer wavelength and smaller amplitude than the lateral grooves.

Further, in some examples a depth of each waved lateral groove may be less than a depth of each angled channel and a width of each waved lateral groove may be less than a width of each angled channel.

In some examples, the ground contacting surface 114 may include a perimeter channel 516 extending around and adjacent to an outer perimeter 518 of the ground contacting surface and including welting. The outer perimeter 518 of the ground contacting surface may form a smooth outer edge along the perimeter of the ground contacting surface. The lateral waved grooves, the lateral waved sipes, and the angled channels may open into the perimeter channel in order to direct water away from the ground contacting surface and outwardly from the shoe. In some examples, the perimeter channel may include welt stitching 520 or the like which may be used to affix outsole 112 to upper 110.

As remarked above, the outsole may be flexible so that the lateral sipes are moveable between a closed position and an open position as the article of footwear bends about the lateral axis. When the foot of the wearer is flat on the ground, the sipes are in the closed position such that the two edges of the cut are contiguous with one another. When the foot of the wearer is bent or walking, the sipes are in the open position. In the open position, more space may be provided for water in the outsole. Additionally, the sipes give the sole greater flexibility and may allow the wearer greater dexterity, which may be advantageous when operating a boat, for example.

Specifically, the depths of the cut to form the sipes may be such that as the shoe is bent about the lateral axis, the flexibility of the sole's material enables the sipes to open up, whereas the void of the grooves 512 remains substantially unchanged.

For example, FIG. 6 shows a bottom view of article of footwear 100 as it is bent about the lateral axis. When the ground contacting surface is bent about the lateral axis the waved lateral sipes may open into an open position in order to provide greater traction during wet conditions.

It will be appreciated that the configurations disclosed herein are exemplary in nature, and that these specific embodiments are not to be considered in a limiting sense, because numerous variations are possible. For example, the above technology can be applied to various types of footwear, such as boots and dress shoes. In another example, the technology can be applied to men's, women's, and children's footwear. Further, the technology can be applied to water-submersible shoes. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An article of footwear including a heel, a toe, a longitudinal axis extending between the heel and the toe, and a lateral axis perpendicular to the longitudinal axis, comprising:

an upper; and an outsole, the outsole including a ground contacting surface, the ground contacting surface including:

a first and second plurality of angled channels, the first and second plurality of angled channels angled with substantially the same angle relative to the longitudinal and lateral axes, where each angled channel in the first plurality of angled channels extends from the toe to an outer edge of a mid-foot region of the outsole at an outer side of the article of footwear, and where each angled channel in the second plurality of angled channels extends from a back portion of the heel towards a front portion of the heel;

a plurality of laterally-extending waved grooves including grooves intersecting the first plurality of angled channels and grooves intersecting the second plurality of angled channels;

a plurality of laterally-extending waved sipes including sipes intersecting the plurality of laterally-extending waved grooves, sipes intersecting the first plurality of angled channels, and sipes intersecting the second plurality of angled channels; and a ground contacting perimeter channel extending around the ground contacting surface, the perimeter channel adjacent to an outer perimeter of the ground contacting surface, the perimeter channel includes welt stitching and wherein each sipe extends laterally from welt stitching on one side of the outsole to welt stitching on the other side of the outsole.

2. The article of footwear of claim 1, wherein the laterally-extending waved grooves, the laterally-extending waved sipes, and the angled channels open into the perimeter channel.

3. The article of footwear of claim 1, wherein each angled channel has a first wall and a second wall which intersect to form the angled channel, the first wall sloped towards an outer side on the article of footwear, the second wall perpendicular to the ground contacting surface when the article of footwear is flat on the ground.

4. The article of footwear of claim 1, wherein each angled channel in the first plurality of angled channels is longer than each angled channel in the second plurality of angled channels.

5. The article of footwear of claim 1, wherein a depth of each waved lateral groove is less than a depth of each angled channel and wherein a width of each waved lateral groove is less than a width of each angled channel.

6. The article of footwear of claim 1, wherein the laterally-extending waved grooves and the laterally-extending waved sipes are sinusoidally shaped and axes of the laterally-extending waved grooves are not parallel to axes of the laterally-extending waved sipes.

7. The article of footwear of claim 1, wherein the laterally extending waved grooves and the laterally-extending waved sipes are sinusoidally shaped and the laterally-extending waved sipes have a longer wavelength and smaller amplitude than the laterally-extending waved grooves.

8. The article of footwear of claim 1, wherein the outsole is flexible and the laterally-extending waved sipes are moveable between a closed position and an open position as the article of footwear bends about the lateral axis.

9. The article of footwear of claim 1, wherein the first plurality of angled channels have the same depth and shape as the second plurality of angled channels.

10. The article of footwear of claim 1, further comprising a toe cap co-molded with the outsole, the toe cap extending upwards over a forefoot portion of the upper, the toe cap having a first coloration and the outsole having a second coloration, the second coloration different from the first coloration.

11. The article of footwear of claim 10, wherein the first coloration is substantially the same as a coloration of the upper.

12. An article of footwear including a heel, a toe, a longitudinal axis extending between the heel and the toe, and a lateral axis perpendicular to the longitudinal axis, comprising:

an upper;

an outsole, the outsole including a ground contacting surface, the ground contacting surface including a first and second plurality of angled channels, the first and second plurality of angled channels angled at the same angle relative to the longitudinal and lateral axes, and where the ground contacting surface further includes a ground contacting perimeter channel extending around the ground contacting surface, the perimeter channel adjacent to an outer perimeter of the ground contacting surface and the perimeter channel includes welt stitching; and a toe cap co-molded with the outsole, the toe cap extending upwards over a forefoot portion of the upper, the toe cap having a first coloration and the outsole having a second coloration, the second coloration different from the first coloration, wherein the first coloration is substantially the same as a coloration of the upper.

13. The article of footwear of claim 12, wherein the upper and outsole are coupled together at a material interface, the first coloration of the toe cap and the second coloration of the outsole form a color interface between the toe cap and the outsole, and wherein the color interface is substantially continuous with the material interface.

14. The article of footwear of claim 12, wherein each angled channel in the first plurality of angled channels extends from the toe to an outer edge of a mid-foot region of the outsole at an outer side of the article of footwear, and where each angled channel in the second plurality of angled channels extends from a back portion of the heel towards a front portion of the heel.

15. The article of footwear of claim 12, wherein the ground contacting surface further includes:

a plurality of laterally-extending waved grooves intersecting the first and second plurality of angled channels; and a plurality of laterally-extending waved sipes intersecting the plurality of laterally-extending waved grooves and the first and second plurality of angled channels.

16. An article of footwear including a heel, a toe, a longitudinal axis extending between the heel and the toe, a lateral axis perpendicular to the longitudinal axis across the article of footwear, and a vertical axis, comprising:

an outsole, the outsole including a ground contacting surface, the ground contacting surface including:

an angled channel angled relative to the longitudinal and lateral axes, the angled channel having a cross-section with a first substantially vertical inner side wall and a second angled outer sidewall that is angled from a trough of the channel toward an outer edge of the article;

a plurality of laterally-extending waved grooves intersecting the angled channel;

a plurality of laterally-extending waved sipes having cuts intersecting the plurality of laterally-extending waved grooves and the angled channel, the cuts deeper than both the angled channel and the laterally-extending waved grooves; and a ground contacting perimeter channel extending around the ground contacting surface, the perimeter channel adjacent to an outer perimeter of the ground contacting surface, the perimeter channel includes welt stitching and wherein each sipe extends laterally from welt stitching on one side of the outsole to welt stitching on the other side of the outsole.

17. The article of footwear of claim 1, wherein intersection of the grooves and sipes with the angled channels comprises the grooves and sipes continuing over the surfaces of the angled channels.

18. The article of footwear of claim 16, wherein intersection of the grooves and sipes with the angled channel comprises the grooves and sipes continuing over the surface of the angled channel.

* * * * *